United States Patent [19]

Bartholic

[11] 4,263,128

[45] Apr. 21, 1981

[54] UPGRADING PETROLEUM AND RESIDUAL FRACTIONS THEREOF

[75] Inventor: David B. Bartholic, Watchung, N.J.

[73] Assignee: Engelhard Minerals & Chemicals Corporation, Menlo Park, N.J.

[21] Appl. No.: 90,247

[22] Filed: Nov. 1, 1979

Related U.S. Application Data

[63] Continuation-in-part of Ser. No. 875,326, Feb. 6, 1978, abandoned, and a continuation-in-part of Ser. No. 38,928, May 14, 1979.

[51] Int. Cl.[3] ..... C10G 25/08

[52] U.S. Cl. ..... 208/91; 208/93; 208/251 R; 208/299; 208/305; 208/309; 208/127

[58] Field of Search ..... 208/91, 93, 127, 153, 208/251 R, 309, 299, 305

[56] References Cited

U.S. PATENT DOCUMENTS

| | | | |
|---|---|---|---|
| 2,378,531 | 7/1945 | Becker | 208/91 |
| 2,462,891 | 3/1949 | Noll | 208/73 |
| 2,472,723 | 6/1949 | Peet | 208/91 |
| 2,800,433 | 7/1957 | Read | 208/93 |

*Primary Examiner*—Herbert Levine
*Attorney, Agent, or Firm*—Inez L. Moselle

[57] ABSTRACT

Whole crude and bottoms fractions from distillation of petroleum are upgraded by high temperature, short time contact with a fluidizable solid of essentially inert character to deposit high boiling components of the charge on the solid whereby Conradson Carbon values, salt content and metal content are reduced. The upgraded hydrocarbon fraction may be supplied to fractionator, in which case the high temperatue contactor serves as a heater, e.g. crude heater for crude distillation, in addition to improving quality of the fractions derived by distillation. For charge stocks boiling above about 500°-650° F., the upgrading process yields a product suitable for charge to catalytic cracking in that Conradson Carbon, salts and metals are reduced to levels tolerable in catalytic cracking.

39 Claims, 1 Drawing Figure

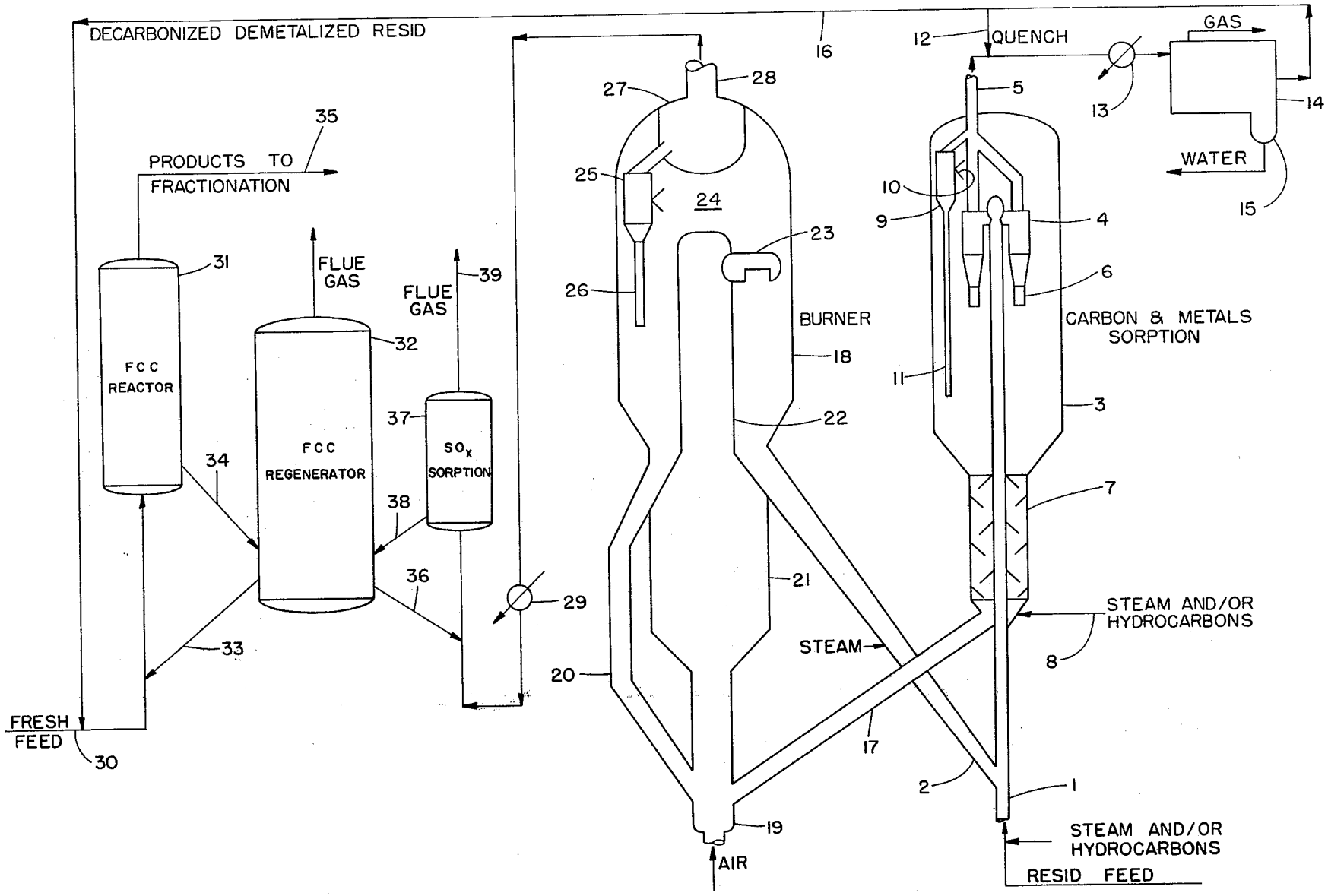
GAS
WATER
QUENCH
CARBON & METALS SORPTION
STEAM AND/OR HYDROCARBONS
STEAM AND/OR HYDROCARBONS
RESID FEED
BURNER
STEAM
AIR
DECARBONIZED DEMETALIZED RESID
FLUE GAS
FLUE GAS
PRODUCTS TO FRACTIONATION
FCC REGENERATOR
FCC REACTOR
SOx SORPTION
FRESH FEED

UPGRADING PETROLEUM AND RESIDUAL FRACTIONS THEREOF

CROSS-REFERENCE TO RELATED APPLICATION

This application is a continuation-in-part of copending application Ser. No. 875,326, filed Feb. 6, 1978 now abandoned and is a continuation-in-part of copending application Ser. No. 038,928, filed May 14, 1979.

BACKGROUND OF THE INVENTION

The invention is concerned with increasing the portion of heavy petroleum crudes which can be utilized as catalytic cracking feed stock to produce premium petroleum products, particularly motor gasoline of high octane number, or as high quality heavy fuel. The heavy ends of many crudes are high in Conradson Carbon and metals which are undesirable in catalytic cracking feed stocks and in products such as heavy fuel. The present invention provides an economically attractive method for selectively removing and utilizing these undesirable components from whole crudes and from the residues of atmospheric and vacuum distillations, commonly called atmospheric and vacuum residua or "resids". The terms "residual stocks", "resids" and similar terminology will be used here in a somewhat broader sense than is usual to include any petroleum fraction remaining after fractional distillation to remove some more volatile components. In that sense "topped crude" remaining after distilling off gasoline and lighter is a resid. The undesirable CC (for Conradson Carbon) and metal bearing compounds present in the crude tend to be concentrated in the resids because most of them are of high boiling point.

When catalytic cracking was first introduced to the petroleum industry in the 1930's the process constituted a major advance in its advantages over the previous technique for increasing the yield of motor gasoline from petroleum to meet a fast growing demand for that premium product. The catalytic process produces abundant yields of high octane naphtha from petroleum fractions boiling above the gasoline range, upwards of about 400° F. Catalytic cracking has been greatly improved by intensive research and development efforts and plant capacity has expanded rapidly to a present day status in which the catalytic cracker is the dominant unit, the "workhorse" of a petroleum refinery.

As installed capacity of catalytic cracking has increased, there has been increasing pressure to charge to those units greater proportions of the crude entering the refinery. Two very effective restraints oppose that pressure, namely Conradson Carbon and metals content of the feed. As these values rise, capacity and efficiency of the catalytic cracker are adversely affected.

Quality of heavy fuels such as Bunker Oil and heavy gas oil is also increasingly affected as it becomes necessary to prepare these from crudes of high CC, metals and salt contents.

The effect of higher Conradson Carbon in catalytic cracking is to increase the portion of the charge converted to "coke" deposited on the catalyst. As coke builds up on the catalyst, the active surface of the catalyst is masked and rendered inactive for the desired conversion. It has been conventional to burn off the inactivating coke with air to "regenerate" the active surfaces, after which the catalyst is returned in cyclic fashion to the reaction stage for contact with and conversion of additional charge. The heat generated in the burning regeneration stage is recovered and used, at least in part, to supply heat of vaporization of the charge and endothermic heat of the cracking reaction. The regeneration stage operates under a maximum temperature limitation to avoid heat damage of the catalyst. Since the rate of coke burning is a function of temperature, it follows that any regeneration stage has a limit of coke which can be burned in unit time. As CC of the charge stock is increased, coke burning capacity becomes a bottle-neck which forces reduction in the rate of charging feed to the unit. This is in addition to the disadvantage that part of the charge has been diverted to an undesirable reaction product.

Metal bearing fractions contain, inter alia, nickel and vanadium which are potent catalysts for production of coke and hydrogen. These metals, when present in the charge, are deposited on the catalyst as the molecules in which they occur are cracked and tend to build up to levels which become very troublesome. The adverse effects of increased coke are as reviewed above. Excessive hydrogen also raises a bottle-neck problem. The lighter ends of the cracked product, butane and lighter, are processed through fractionation equipment to separate components of value greater than fuel to furnaces, primarily propane, butane and the olefins of like carbon number. Hydrogen, being incondensible in the "gas plant" occupies space as a gas in the compression and fractionation train and can easily overload the system when excessive amounts are produced by high metal content catalyst, causing reduction in charge rate to maintain the FCC Unit and auxiliaries operative.

In heavy fuels, used in stationary furnaces, turbines, marine and large stationary diesel engines, quality is a significant factor. For example, petroleum ash, particularly vanadium and sodium, attacks furnace refractories and turbine blades.

These problems have long been recognized in the art and many expedients have been proposed. Thermal conversions of resids produce large quantities of solid fuel (coke) and the pertinent processes are characterized as coking, of which two varieties are presently practiced commercially. In delayed coking, the feed is heated in a furnace and passed to large drums maintained at 780°–840° F. During the long residence time at this temperature, the charge is converted to coke and distillate products taken off the top of the drum for recovery of "coker gasoline", "coker gas oil" and gas. The other coking process now in use employs a fluidized bed of coke in the form of small granules at about 900° to 1050° F. The resid charge undergoes conversion on the surface of the coke particles during a residence time on the order of two minutes, depositing additional coke on the surfaces of particles in the fluidized bed. Coke particles are transferred to a bed fluidized by air to burn some of the coke at temperatures upwards of 1100° F., thus heating the residual coke which is then returned to the coking vessel for conversion of additional charge.

These coking processes are known to induce extensive cracking of components which would be valuable for FCC charge, resulting in gasoline of lower octane number (from thermal cracking) than would be obtained by catalytic cracking of the same components. The gas oils produced are olefinic, containing significant amounts of diolefins which are prone to degradation to coke in furnace tubes and on cracking catalysts.

It is often desirable to treat the gas oils by expensive hydrogenation techniques before charging to catalytic cracking or blending with other fractions for fuels. Coking does reduce metals and Conradson Carbon, but still leaves an inferior gas oil for charge to catalytic cracking.

Catalytic charge stock and fuel stocks may also be prepared from resids by "deasphalting" in which an asphalt precipitant such as liquid propane is mixed with the oil. Metals and Conradson Carbon are drastically reduced but at low yield of deasphalted oil.

Solvent extractions and various other techniques have been proposed for preparation of FCC charge stock from resids. Solvent extraction, in common with propane deasphalting, functions by selection on chemical type, rejecting from the charge stock the aromatic compounds which can crack to yield high octane components of cracked naphtha. Low temperature, liquid phase sorption on catalytically inert silica gel is proposed by Shuman and Brace, Oil and Gas Journal, Apr. 6, 1953, page 113. See also U.S. Pat. Nos. 2,378,531, 2,462,891 and 2,472,723, cited in the said parent application Ser. No. 875,326, filed Feb. 6, 1978.

SUMMARY OF THE INVENTION

These problems of the prior art are now overcome in a process of contacting a resid with an inert solid of low surface area at high temperatures for very short residence times of 2 seconds or less, preferably less than 0.5 second, separating oil from the solid and quenching the oil below cracking temperature as rapidly as possible. The necessary short residence time is conveniently achieved by supply of the solid in a size of about 20 to 150 microns particle diameter mixed with the resid charge in a riser. The oil is introduced at a temperature below thermal cracking temperature in admixture with steam and/or water to reduce partial pressure of volatile components of the charge. The catalytically inert solid is supplied to a rising column of charge at a temperature and in an amount such that the mixture is at a temperature upwards of 700° F. to 1050° F. sufficient to vaporize most of the charge.

As noted, the contact temperature will be high enough to vaporize most of the charge, above 900° F. for resids boiling above about 500° to 650° F. For stocks containing light ends, such as whole crudes and topped crudes, a contact temperature will be chosen above the average boiling point of the stock, as defined by Bland and Davidson, "Petroleum Processing Handbook" at page 14-4, that is, at a temperature above the sum of ASTM distillation temperatures from the 10 percent point to the 90 percent point, inclusive, divided by nine.

At the top of the riser the solid is rapidly separated from oil vapors and the latter are quenched to temperatures at which thermal cracking is essentially arrested. During the course of this very short contact, the heavy components of high Conradson Carbon value containing the majority of the metal content are laid down on the solid particles. This deposition may be a coalescing of liquid droplets, adsorption, condensation or some combination of these mechanisms. In any event, there appears to be little or no conversion of a chemical nature. Particularly, thermal cracking is minimal. The quantity removed from the charge under preferred conditions is very nearly that indicated by Conradson Carbon of the resid charged. Further, the hydrogen content of the deposit on the solids is believed to be about 6%, below the 7–8% normal in FCC coke.

The solids, now bearing deposits of the high CC and metals components of the resid, are then contacted with air, for example, by any of the techniques suited to regeneration of FCC catalyst, preferably under conditions of full CO combustion to less than 1000 ppm CO in the flue gas. Combustion of the deposited material from the inert solids generates the heat required in the contacting step when the inert solid is returned to the riser.

DESCRIPTION OF THE DRAWINGS

A system for preparing charge stock to an FCC Unit is shown in the single FIGURE of the annexed drawing.

DESCRIPTION OF PREFERRED EMBODIMENTS

The decarbonizing, demetallizing step which characterizes the present invention is preferably conducted in a contactor very similar in construction and operation to the riser reactors employed in modern FCC Units. Typically, a resid feed, either a vacuum resid boiling above 900° F. or an atmospheric resid which may contain components boiling as low as 500° F., is introduced to the lower end of a vertical conduit. Volatile material such as light hydrocarbons recycled in the process, steam and/or water in amounts to substantially decrease hydrocarbon partial pressure is added with the feed stock. Pressures will be sufficient to overcome pressure drops, say 15 to 50 psia. The charge may be preheated in a furnace, not shown, before introduction to the riser contactor, to any desired degree below thermal cracking temperature, e.g., 200°–800° F., preferably 300°–700° F. Higher temperatures will induce thermal cracking of the feed with production of low octane naphtha.

The feed diluted by light hydrocarbons, steam or the like, rise in the contactor 1 at high velocity such as 40 feed per second. Hot inert solid in finely divided form is introduced to the feed from a standpipe 2 in a quantity and at a temperature to provide a mixture at a suitable elevated temperature to volatilize all components of the feed except the very heavy compounds of high CC and high metal content.

The solid contacting agent is essentially inert in the sense that it induces minimal cracking of heavy hydrocarbons by the standard microactivity test conducted by measurement of amount of gas oil converted to gas, gasoline and coke by contact with the solid in a fixed bed. Charge in that test is 0.8 grams of mid-Continent gas oil of 27° API contacted with 4 grams of catalyst during 48 second oil delivery time at 910° F. This results in a catalyst to oil ratio of 5 at weight hourly space velocity (WHSV) of 15. By that test, the solid here employed exhibits a microactivity less than 20, preferably about 10. A preferred solid is microspheres of calcined kaolin clay. Other suitable inert solids include in general, any other solid which satisfies the stated criteria of a microactivity for catalytic cracking not substantially greater than 20, a surface area of about 10 to about 15 square meters per gram and pores of which most are in the range of 150 to 600 Angstrom Units.

The microspheres of calcined kaolin clay preferably used in the process of the invention are known in the art and are employed as a chemical reactant with a sodium hydroxide solution in the manufacture of fluid zeolitic cracking catalysts as described in U.S. Pat. No. 3,647,718 to Haden et al. In practice of the instant invention, in contrast, the microspheres of calcined kaolin clay are not used as a chemical reactant. Thus the chemical composition of the microspheres of calcined clay used in practice of this invention corresponds to that of a dehydrated kaolin clay. Typically, the calcined microspheres analyze about 51% to 53% (wt.) $SiO_2$, 41 to 45% $Al_2O_3$, and from 0 to 1% $H_3O$, the balance being minor amounts of indigenous impurities, notably iron, titanium and alkaline earth metals, Generally, iron content (expressed as $Fe_2O_3$) is about ½% by weight and titanium (expressed as $TiO_2$) is approximately 2%.

The microspheres are preferably produced by spray drying an aqueous suspension of kaolin clay. The term "kaolin clay" as used herein embraces clays, the predominating mineral constituent of which is kaolinite, halloysite, nacrite, dickite, anauxite and mixtures thereof. Preferably a fine particle size plastic hydrated clay, i.e., a clay containing a substantial amount of submicron size particles, is used in order to produce microspheres having adequate mechanical strength.

To facilitate spray drying, the powdered hydrated clay is preferably dispersed in water in the presence of a deflocculating agent exemplified by sodium silicate or a sodium condensed phosphate salt such as tetrasodium pyrophosphate. By employing a deflocculating agent, spray drying may be carried out at higher solids levels and harder products are usually obtained. When a deflocculating agent is employed, slurries containing about 55 to 60% solids may be prepared and these high solids slurries are preferred to the 40 to 50% slurries which do not contain a deflocculating agent.

Several procedures can be followed in mixing the ingredients to form the slurry. One procedure, by way of example, is to dry blend the finely divided solids, add the water and then incorporate the deflocculating agent. The components can be mechanically worked together or individually to produce slurries of desired viscosity characteristics.

Spray dryers with countercurrent, cocurrent or mixed countercurrent and cocurrent flow of slurry and hot air can be employed to produce the microspheres. The air may be heated electrically or by other indirect means. Combustion gases obtained by burning hydrocarbon fuel in air can be used.

Using a cocurrent dryer, air inlet temperatures to 1200° F. may be used when the clay feed is charged at a rate sufficient to produce an air outlet temperature within the range of 250° F. to 600° F. At these temperatures, free moisture is removed from the slurry without removing water of hydration (water of crystallization) from the raw clay ingredient. Dehydration of some or all of the raw clay during spray drying is contemplated. The spray dryer discharge may be fractionated to recover microspheres of desired particle size. Typically particles having a diameter in the range of 20 to 150 microns are preferably recovered for calcination. The calcination may be conducted in the manufacturing operation or by adding the spray dried particles to the burner described below.

While it is preferable in some cases to calcine the microspheres at temperatures in the range of about 1600° F. to 2100° F. in order to produce particles of maximum hardness, it is possible to dehydrate the microspheres by calcination at lower temperatures; for example, temperatures in the range of 1000° F. to 1600° F., thereby converting the clay into the material known as "metakaolin". After calcination the microspheres should be cooled and fractionated, if necessary, to recover the portion which is in desired size range.

Pore volume of the microspheres will vary slightly with the calcination temperature and duration of calcination. Pore size distribution analysis of a representative sample obtained with a Desorpta analyzer using nitrogen desorption indicates that most of the pores have diameters in the range of 150 to 600 Angstrom units.

The surface area of the calcined microspheres is usually within the range of 10 to 15 $m^2/g$. as measured by the well-known B.E.T. method using nitrogen absorption. It is noted that the surface areas of commercial fluid zeolitic catalysts is considerably higher, generally exceeding values of 100 $m^2/g$. as measured by the B.E.T. method.

Other solids of low catalytic activity, low surface area and of like particle size may be employed, as described above. In general, solids of low cost are recommended since it may be desirable to discard a sizeable portion of the contact agent in the system from time to time and replace it with fresh agent to maintain a suitable level of metals. Since the solid is preferably of low porosity, resulting in deposition primarily on external surfaces, the invention contemplates abrading the particles as in a column of air at velocity to permit refluxing of solids for removal of external metal deposits.

Length of the riser contactor 1 is such as to provide a very short time of contact between the feed and the contacting agent, less than 2 seconds, preferably 0.5 second or less. The contact time should be long enough to provide good uniformity of contact between feed and contacting agent, say at least 0.1 second.

At the top of the riser, e.g., 15 to 20 feed above the point of introduction of contacting agent from standpipe 2 at a feed velocity of 40 feet per second, vaporized hydrocarbons are separated as rapidly as possible from particulate solids bearing the high CC deposits and metals, if any. This may be accomplished by discharge from the riser into a large disengaging zone defined by vessel 3. However, it is preferred that the riser vapors discharge directly into cyclone separators 4 from which vapors are transferred to vapor line 5 while entrained solids drop into the disengaging zone by diplegs 6 to stripper 7 where steam admitted by line 8 evaporates traces of volatile hydrocarbons from the solids. The mixture of steam and hydrocarbons, together with entrained solids enters cyclone 9 by mouth 10 to disengage the suspended solids for return to stripper 7 by dipleg 11. As well knwon in the Fluid Cracking art, there may be a plurality of cyclones 4 and cyclones 9 and the cyclones may be multi-stage, with gas phase from a first stage cyclone discharging to a second stage cyclone.

In one embodiment, the cyclones 4 may be of the stripper cyclone type described in U.S. Pat. No. 4,043,899, the entire disclosure of which is hereby incorporated by this reference. In such case, the stripping steam admitted to the cyclone may be at a low temperature, say 400° to 500° F., and serve to perform part or all of the quenching function presently to be described.

The vaporized hydrocarbons from cyclones 4 and 10 passing by way of line 5 are then mixed with cold hydrocarbon liquid introduced by line 12 to quench thermal cracking. The quenched product is cooled in condenser 13 and passed to accumulator 14 from which gases are removed for fuel and water, if any, is taken from sump 15, preferably for recycle to the contactor for generation of steam to be used as an aid in vaporizing charge at the bottom of the riser and/or removing heat from the burner. Condenser 13 is advantageously set up as a heat exchanger to preheat charge to the contactor or preheat charge to the FCC Unit hereinafter described and the like.

In one embodiment, the quenching is advantageously conducted in a column equipped with vapor-liquid contact zones such as disc and doughnut trays and valve trays. Bottoms from such column quencher could go directly to catalytic cracking with overhead passing to condenser 13 and accumulator 14 or to line 8 at the bottom of contactor 1.

Certain advantages can be realized in the system by using recycled light hydrocarbons at the bottom of riser-contactor 1 for vapor pressure reduction. It will be apparent that recycle of water from accumulator 14 for that purpose requires that the effluent of the contactor be cooled to the point of condensation of water, which in this water vapor/hydrocarbon vapor system is about 150° F. When hydrocarbons are used for vapor pressure reduction and as the stripping medium at line 8, condensation becomes unnecessary and the riser effluent (less the amount recycled for vapor pressure reduction and/or stripping) may be passed directly to a catalytic cracking reactor. In such case, the riser contactor functions as the cat cracker preheat furnace.

Similar advantage from hydrocarbon recycle is realized when charging whole crude or topped crude to the riser-contactor 1 and passing the effluent to a fractionating column. In such case, the riser-contactor functions as a crude furnace to preheat charge for the crude distillation stage in addition to removing salts, metals and Conradson Carbon. Fractions from the crude still will include hydrocarbons for recycle, gasoline, kerosene, gas oil, and a heavy bottoms for fuel, FCC charge or the like.

The light hydrocarbons, preferably recycled in the process, will be chosen to boil below the contacting temperature of riser 1. Those light hydrocarbons may be the gas fraction derived from the process or like hydrocarbon gas from other source. Alternatively, the hydrocarbons used to aid in vaporization of the charge may be naphtha, kerosene, gas oil. These may come from external sources, but preferably are derived by recycle in the process.

The liquid hydrocarbon phase from accumulator 14 may be a desalted, decarbonized and demetallized resid fraction which is now satisfactory charge for catalytic cracking. This product of contact in riser 1 may be used in part as the quench liquid at line 12. The balance is preferably transferred directly to a catalytic cracker by line 16.

Returning now to stripper 7, the inert solid particle bearing a deposit of high CC and metallic compounds passes by a standpipe 17 to the inlet of burner 18. Standpipe 17 discharges to a riser inlet 19 of burner 18 where it meets a rising column of air introduced by line 19 and is mixed with hot inert particles from burner recycle 20 whereby the mixture is rapidly raised to a temperature for combustion of the deposits from treating resid, 1200°–1400° F. The mixture enters an enlarged zone 21 to form a small fluidized bed for thorough mixing and initial burning of deposits. The flowing stream of air carries the burning mass through a restricted riser 22 to discharge at 23 into an enlarged disengaging zone. The hot, burned particles, now largely free of combustible deposit fall to the bottom of the disengaging zone from which a part enters recycle 20 and another part enters the standpipe 2 for supply to contactor 1 after steam stripping. By reason of the very high temperatures attainable in this type of burner and in the presence of a stoichiometric excess of oxygen, CO will burn to provide a flue gas containing very little of that gas. In other types of burners, the combustion products may contain substantial amounts of CO which can be burned for its heating value in CO boilers of the type commonly used in FCC Units.

In the type of burner shown, the gaseous products of combustion, containing carbon dioxide, some residual oxygen, nitrogen, oxides of sulfur and perhaps a trace of CO, enter a cyclone 25 (one of a plurality of such devices) to disengage entrained solids for discharge by dipleg 26. The clarified gases pass to a plenum 27 from which flue gas is removed by outlet 28.

Although the system just described bears superficial resemblance to an FCC Unit, its operation is very different from FCC. Most importantly, the riser contactor 1 is operated to remove from the charge an amount not greatly in excess of the Conradson Carbon number of the feed. This contrasts with normal FCC "conversion" of 50–70%, measured as the percentage of FCC product not boiling within the range of the charge. Percent removed by the present process is preferably on the order of 10% to 20% on charge and constituted by gas, gasoline and deposit on the solid contacting agent. Rarely will the amount removed from boiling range of the charge exceed a value, by weight, more than 3 to 4 times the Conradson Carbon value of the charge. This result is achieved by a very low severity of cracking due to inert character of the solid and the very short residence time at cracking temperature. As is well known, cracking severity is a function of time and temperature. Increased temperature may be compensated by reduced residence time, and vice versa.

The new process affords a control aspect not available to FCC Units in the supply of hydrocarbons or steam to the riser contactor. When processing stocks of high CC, the burner temperature will tend to rise because of increased supply of fuel to the burner. This may be compensated by increasing the hydrocarbons or steam supplied to reduce partial pressure of hydrocarbons in the riser contactor or by recycling water from the overhead receiver to be vaporized in the riser to produce steam.

The riser contact with inert solid thus provides a novel sorption technique for removing the polynuclear aromatic compounds of resids (high CC and metals) while these are carried in a stream of low hydrocarbon partial pressure by reason of hydrocarbons or steam supplied to the riser.

The decarbonized, desalted and/or demetalized resid is good quality FCC charge stock and is transferred by line 16 to feed line 30 of an FCC reactor 31 operated in the conventional manner. Hot, regenerated catalyst is transferred from FCC regenerator 32 by standpipe 33 for addition to the reactor charge. Spend catalyst from reactor 31 passes by standpipe 34 to the regenerator 32, while cracked products leave reactor 31 by transfer line 35 to fractionation for recovery of gasoline and other conversion products.

Many residual fractions are high in sulfur content, particularly in the heavy components. The sulfur is oxidized to sulfur oxides ($SO_x$) in the burner 18 and these undesirable gases form part of the flue gas discharged at 28. In a preferred embodiment of the invention, the FCC Unit operates on a catalyst designed for reduction of $SO_x$ emissions. Several such catalysts are known in the art. Such catalysts will absorb $SO_x$ in the oxidizing environment of the regenerator. Catalyst which contains sorbed sulfur is then transferred to the reducing atmosphere of the reactor. In that reducing atmosphere and in the presence of water, the sulfur is converted to hydrogen sulfide, readily removed from reactor products in the usual gas plant and treating facilities of a refinery. See Belgian pat. Nos. 849,635, 849,636 and 849,637.

As shown in the drawing, a drag stream of catalyst from regenerator 32 is passed by standpipe 36 to mix with cooled flue gas passed from burner 18 through heat exchanger 29. The mixture is then transferred to a fluidized bed contactor 37 resulting in sorption of $SO_x$ from the flue gas of burner 18. Catalyst carrying sorbed (reacted) $SO_x$ is conveyed by standpipe 38 back to regenerator 32 for ultimate reaction in reactor 31. After cyclonic separation of entrained catalyst, flue gas from which $SO_x$ has been so removed is then discharged by line 39 for recovery of the heat energy contained therein as by expansion turbines driving air blowers for regenerator 32 and burner 18; by waste heat boilers or the like.

EXAMPLES

The effect of contacting in the manner described above has demonstrated in laboratory scale equipment. The apparatus employed is a circulating fluidized bed pilot plant which simulates behavior of commercial FCC riser reactors. The reactor is equipped to provide a stream of nitrogen through the riser and for addition of catalyst and charge. The riser is lagged and heated to maintain isothermal conditions. The nitrogen flow serves the same function as the hydrocarbons or steam described above for reduction in partial pressure of hydrocarbons. In the runs described below residual stocks and the microspheres set forth above were contacted under the conditions recited. Inspection data on the charge stock are given in Table I.

TABLE I

DESCRIPTION OF CHARGE STOCKS

| | Example 1 | Example 2 |
|---|---|---|
| Gravity, °API | 27.9 | 23 |
| Ramsbottom Carbon, % | 0.35 | 2.5 |
| Metals, ppm | | |
| Ni | 1 | 10 |
| Cu | 1 | 1 |
| V | 1 | 20 |
| Distillation, °F. | | |
| IBP | 438 | 420 |
| 10% | 554 | 478 |
| 30 | 659 | 711 |
| 50 | 750 | 829 |
| 70 | 847 | 979 |
| 76 | — | 1046 |
| 90 | 991 | — |
| 94 | 1050 | — |

Conditions of contact and resultant products are shown in Table II.

TABLE II

CONTACT CONDITIONS AND PRODUCTS

| | Example 1 | Example 2 |
|---|---|---|
| Rise contactor temp., °F. | 930 | 930 |
| Contact time, seconds | 0.66 | 0.97 |
| Contact solid temp., °F. | 1200 | 1200 |
| Oil partial pressure, psia | 2.83 | 4.62 |
| Oil preheat temp., °F. | 640 | 655 |
| Solids/oil, wt. | 12.5 | 12.2 |

TABLE II-continued

CONTACT CONDITIONS AND PRODUCTS

| | Example 1 | Example 2 |
|---|---|---|
| Mol ratio, $N_2$/oil | 3.7 | 2.2 |
| Products, wt. % | | |
| Gas | 7.9 | 7.6 |
| Liquid | 90.4 | 85.5 |
| Deposit on solid | 1.7 | 6.9 |
| Liquid Product | | |
| Metals, ppm | | |
| Ni | — | 1.5 |
| Cu | — | 1.0 |
| V | — | 1.0 |
| Ramsbottom Carbon | — | 0.6 |
| Distillation, °F. | | |
| IBP | 170 | 173 |
| 10% | 466 | 475 |
| 30 | 597 | 610 |
| 50 | 684 | 704 |
| 70 | 775 | 803 |
| 90 | 894 | 967 |
| 93 | — | 1033 |
| EP | 1028 | — |

Of particular interest is the observation that the gas fraction obtained in the above examples is largely saturated and contains a substantial quantity of propane having premium value as liquified petroleum gas (LPG).

I claim:

1. In a process for preparing premium products from crude petroleum by fractionally distilling the crude petroleum to separate gasoline and distillate gas oil from a residual fraction having a substantial Conradson Carbon number and charging the distillate gas oil to catalytic cracking; the improvement which comprises contacting said residual fraction in a rising confined vertical column with an inert solid material having a microactivity for catalyst cracking not substantially greater than 20 at low severity, including a temperature of at least about 900° F. for a period of time less than two seconds and less than that which induces substantial thermal cracking of said residual fraction, at the end of said period of time separating from said inert solid a decarbonized residual fraction of reduced Conradson Carbon number as compared with said residual fraction, reducing temperature of the said separated fraction to a level below that at which substantial thermal cracking takes place and adding said decarbonized residual fraction to said distillate gas oil as additional charge to said catalytic cracking.

2. A process according to claim 1 wherein said severity is at a level such that the quantity of said decarbonized residual fraction is less than said residual fraction by a weight percent no greater than twice said Conradson Carbon number.

3. A process according to claim 1 wherein said solid is introduced to said rising column at a temperature substantially above the temperature of said residual fraction.

4. A process according to claim 1 wherein said inert solid is subjected to air at elevated temperature after contact with said residual fraction to thereby remove combustible deposit from said solid by burning and thereby heat the solid.

5. A process according to claim 4 wherein the temperature of said contacting is provided by returning the heated solid after subjection to air as aforesaid to contact with residual fraction in said contacting.

6. A process according to claim 4 wherein the catalyst in said catalytic cracking is adapted to sorb oxides of sulfur in an oxidizing atmosphere and release sulfur oxides in a reducing atmosphere and combustion products from said burning are contacted with said catalyst for removal of oxides of sulfur from said combustion products.

7. A process according to claim 1 wherein said inert solid is calcined clay.

8. A process according to claim 1 wherein said period of time is less than about 0.5 second.

9. In a process for preparing premium products from crude petroleum by fractionally distilling the crude petroleum to separate distillates from a residual fraction having a substantial Conradson Carbon number; the improvement which comprises contacting said residual fraction in a rising confined vertical column which an inert solid material having a microactivity for catalytic cracking not substantially greater than 20 at low severity, including a temperature of at least about 900° F. for a period of time less than that which induces substantial thermal cracking of said residual fraction, separating from said contacting a decarbonized residual fraction of reduced Conradson Carbon number as compared with said residual fraction and promptly quenching said separated residual fraction to a temperature below that at which substantial thermal cracking takes place.

10. A process according to claim 9 wherein said severity is at a level such that the quantity of said decarbonized residual fraction is less than said residual fraction by a weight percent no greater than twice said Conradson Carbon number.

11. A process according to claim 9 wherein said solid is introduced to said rising column at a temperature substantially above the temperature of said residual fraction.

12. A process according to claim 9 wherein said inert solid is subjected to air at elevated temperature after contact with said residual fraction to thereby remove combustible deposit from said solid by burning and thereby heat the solid.

13. A process according to claim 12 wherein the temperature of said contacting is provided by returning the heated solid after subjection to air as aforesaid to contact with residual fraction in said contacting.

14. A process according to claim 9 wherein said inert solid is calcined clay.

15. A process according to claim 9 wherein said period of time is less than about 0.5 second.

16. A process according to claim 1 or claim 9 wherein said inert solid material is a porous solid having a low surface area below 100 square meters per gram.

17. A process according to claim 1 or claim 9 wherein said inert solid material is a porous solid having a low surface area between about 10 and about 15 square meters per gram.

18. A process according to claim 1 or claim 9 wherein said inert solid material is calcined kaolin.

19. A process according to claim 1 or claim 9 wherein said inert solid material is a porous solid in which most of the pores have diameters of 150 to 600 Angstrom Units.

20. A process according to claim 1 or claim 9 wherein hydrocarbons, steam or water is added to said residual fraction for contacting with said inert solid material in an amount to substantially decrease hydrocarbon partial pressure.

21. In a process for preparing premium products from crude petroleum by fractionally distilling the crude petroleum to separate gasoline and distillate gas oil from a residual fraction having a substantial Conradson Carbon number and charging the distillate gas oil to catalytic cracking; the improvement which comprises contacting said residual fraction and a quantity of water or steam to substantially decrease hydrocarbon partial pressure in a rising confined vertical column with an inert solid material having a microactivity for catalytic cracking not substantially greater than 20, a surface area of about 10 to about 15 square meters per gram and pores of which most are in the range of 150 to 600 Angstrom Units at low severity including a temperature of at least about 900° F. for a period of time below 0.5 seconds and less than that which induces substantially thermal cracking of said residual fraction, at the end of said period of time separating from said inert solid a decarbonized residual fraction of reduced Conradson Carbon number as compared with said residual fraction, reducing temperature of the said separated fraction to a level below that at which substantial thermal cracking takes place and adding said decarbonized residual fraction to said distillate gas oil as additional charge to said catalytic cracking.

22. A process according to claim 21 wherein said inert solid material is calcinated kaolin.

23. In a process for preparing premium products from crude petroleum having a substantial Conradson Carbon number; the improvement which comprises contacting a charge of said crude or a residual fraction thereof containing the highest boiling components of said crude in a rising confined vertical column with an inert solid material having a microactivity for catalytic cracking not substantially greater than 20 at low severity, including a temperature at least equal to the average boiling point of said charge for a period of time less than two seconds and less than that which induces substantial thermal cracking of said charge, at the end of said period of time separating from said inert solid a decarbonized crude or residual fraction thereof product of reduced Conradson Carbon number as compared with said charge and reducing temperature of the said separated fraction to a level below that at which substantial thermal cracking takes place to thereby terminate said period of time.

24. A process according to claim 23 wherein said severity is at a level such that the quantity of said decarbonized crude or residual fraction thereof is less than said charge fraction by a weight percent no greater than twice said Conradson Carbon number.

25. A process according to claim 23 wherein said solid is introduced to said rising column at a temperature substantially above the temperature of said charge.

26. A process according to claim 23 wherein said inert solid is subjected to air at elevated temperature after contact with said charge to thereby remove combustible deposit from said solid by burning and thereby heat the solid.

27. A process according to claim 26 wherein the temperature of said contacting is provided by returning the heated solid after subjection to air as aforesaid to contact with charge in said contacting.

28. A process according to claim 23 wherein said inert solid is calcined clay.

29. A process according to claim 23 wherein said period of time is less than about 0.5 second.

30. A process according to claim 26 wherein said inert solid is calcined clay.

31. A process according to claim 23 wherein said inert solid material is a porous solid having a low surface area below 100 square meters per gram.

32. A process according to claim 23 wherein said inert solid material is a porous solid having a low surface area between about 10 and about 15 square meters per gram.

33. A process according to claim 23 wherein said inert solid material is calcined kaolin.

34. A process according to claim 23 wherein said inert solid material is a porous solid in which most of the pores have diameters of 150 to 600 Angstrom Units.

35. A process according to claim 23 wherein steam or water is added to said charge for contacting with said inert solid material in an amount to substantially decrease hydrocarbon partial pressure.

36. A process according to claim 1, 9, 21 or 23 wherein a light hydrocarbon boiling below the temperature of said contacting is introduced to said rising confined vertical column to aid in vaporization in said rising confined column.

37. A process according to claim 36 wherein said light hydrocarbon is separated from the effluent of said contacting and recycled in the process.

38. A process for upgrading a petroleum charge of a crude oil or a residual fraction which contains high boiling components of substantial Conradson Carbon number which comprises contacting said charge in a confined rising vertical column with a finely divided solid contact material consisting essentially of an inert solid material having a microactivity for catalytic cracking not substantially greater than 20 at low severity, including a temperature of at least about 900° F. for a period of time less than 2 seconds and less than that which induces substantial thermal cracking of said charge, at the end of said period of time separating from said inert solid a decarbonized hydrocarbon fraction of reduced Conradson Carbon number as compared with said charge and reducing temperature of said separated fraction to a level below that at which substantial thermal cracking takes place to terminate said period of time.

39. A process according to claim 38 wherein steam or water is added to said charge for contacting with said inert solid in an amount to substantially decrease hydrocarbon partial pressure.

* * * * *

UNITED STATES PATENT AND TRADEMARK OFFICE

CERTIFICATE OF CORRECTION

PATENT NO. : 4,263,128

DATED : April 21, 1981

INVENTOR(S) : David B. Bartholic

It is certified that error appears in the above-identified patent and that said Letters Patent are hereby corrected as shown below:

Column 5 - line 6 should read -- 45% $Al_2O_3$, and from 0 to 1% $H_2O$, the balance being --

Column 6 - line 31 should read -- At the top of the riser, e.g., 15 to 20 feet above the --; line 47 should read -- 11. As well known in the Fluid Cracking art, there may --

Column 10 - line 38 should read -- . . . for catalytic cracking not substantially greater --

Column 11 - line 17 should read -- fraction in a rising confined vertical column with an --.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*